US005366350A

United States Patent [19]

Fujii et al.

[11] Patent Number: 5,366,350

[45] Date of Patent: Nov. 22, 1994

[54] GAS GUIDING MECHANISM IN A PISTON TYPE COMPRESSOR

[75] Inventors: Toshiro Fujii; Hitoshi Inukai; Koichi Ito; Yuichi Kato, all of Kariya, Japan

[73] Assignee: Kabushiki Kaisha Toyoda Jidoshokki Seisakusho, Kariya, Japan

[21] Appl. No.: 226,818

[22] Filed: Apr. 12, 1994

Related U.S. Application Data

[63] Continuation-in-part of Ser. No. 199,812, Feb. 22, 1994, which is a continuation-in-part of Ser. No. 195,366, Feb. 10, 1994, which is a continuation-in-part of Ser. No. 154,279, Nov. 18, 1993, which is a continuation-in-part of Ser. No. 103,888, Aug. 6, 1993, abandoned, which is a continuation-in-part of Ser. No. 102,588, Aug. 5, 1993, which is a continuation-in-part of Ser. No. 101,927, Aug. 4, 1993, which is a continuation-in-part of Ser. No. 101,178, Aug. 3, 1993.

[30] Foreign Application Priority Data

Apr. 13, 1993 [JP] Japan ..... 5-086563

[51] Int. Cl.[5] ..... F04B 49/00

[52] U.S. Cl. ..... 417/242; 417/269; 251/310

[58] Field of Search ..... 417/269, 242; 251/310; 91/480, 484, 499, 502

[56] References Cited

U.S. PATENT DOCUMENTS

| | | | |
|---|---|---|---|
| 1,367,914 | 2/1921 | Larsson . | |
| 2,160,978 | 6/1939 | Mock | 417/269 |
| 3,288,832 | 11/1966 | Ferrin et al. | 251/310 |
| 4,007,663 | 2/1977 | Nagatomo et al. | 91/499 |
| 5,232,349 | 8/1993 | Kimura et al. | 417/269 |
| 5,286,173 | 2/1994 | Takenaka et al. | 417/269 |

FOREIGN PATENT DOCUMENTS

| | | |
|---|---|---|
| 350135 | 3/1922 | Germany . |
| 392587 | 4/1991 | Japan . |

*Primary Examiner*—Richard A. Bertsch
*Assistant Examiner*—Michael Kocharov
*Attorney, Agent, or Firm*—Brooks Haidt Haffner & Delahunty

[57] ABSTRACT

A piston type compressor is disclosed, which includes pistons disposed in bores of a cylinder block, to be reciprocated by a piston driving mechanism in cooperation with a drive shaft. A valve receiving chamber is formed around the drive shaft in the cylinder block, for receiving a rotary valve to rotate together with the drive shaft. The rotary valve has a suction passage formed therein for providing gases from a gas suction chamber to a compression chamber defined in each bore. A plurality of communication passages are formed in the cylinder block in association with the compression chambers, to provide gas communication between the compression chambers and the valve's suction passage. A bypass passage is formed on the rotary valve, and permits one communication passage, associated with one of the compression chambers which is at a final stage of a compression stroke, to communicate with another communication chamber which is at a start stage of the compression stroke. The compressor further includes a device, provided on an outer surface of each piston, for catching gas axially leaking along the outer surface of the piston. The gas catching device guides gas, caught by the gas catching device at the final stage of the compression stroke, to the communication passage corresponding to its associated compression chamber.

9 Claims, 9 Drawing Sheets

GAS GUIDING MECHANISM IN A PISTON TYPE COMPRESSOR

This application is a continuation-in-part of co-pending U.S. application Ser. No. 08/199,812 filed on Feb. 22, 1994, which is a continuation-in-part of U.S. application Ser. No. 08/195,366 filed Feb. 10, 1994 which is a continuation-in-part of U.S. application Ser. No. 08/154,279 filed Nov. 18, 1993, which is a continuation-in-part of U.S. application Ser. No. 08/103,888 filed on Aug. 6, 1993, now abandoned, which is a continuation-in-part of U.S. application Ser. No. 08/102,588 filed on Aug. 5, 1993, which is a continuation-in-part of U.S. application Ser. No. 08/101,927 filed on Aug. 4, 1993, which is a continuation-in-part of U.S. application Ser. No. 08/101,178 filed on Aug. 3, 1993, all of which are incorporated herein by reference.

BACKGROUND OF THE INVENTION

1. Field of the Invention

The present invention relates generally to a piston type compressor that comprises a drive shaft, a cylinder block having a plurality of cylinder bores arranged around the drive shaft, and a plurality of pistons, which are retained in the cylinder bores and reciprocate with the rotation of the drive shaft. More particularly, this invention relates to a gas venting mechanism in a piston type compressor which is suitable for an air conditioner in a vehicle.

2. Description of the Related Art

A piston type compressor disclosed in, for example, Japanese Unexamined Patent Publication No. 3-92587, is provided with a cylinder block having a plurality of cylinder bores formed therein and pistons which both reciprocate in the cylinder bores and which define compression chambers in the bores. Each compression chamber is connected to a suction chamber formed in the compressor by means of a suction port. These suction ports are opened and closed by flapper type valves disposed in the compression chambers. Refrigerant gas in the suction chamber is drawn into the chamber through the corresponding flapper type valve which is forced open during the suction stroke of the piston moving from the top dead center to the bottom dead center. During the discharge stroke, when the pistons move from the bottom dead center to the top, dead center, the suction ports are closed by the flapper type valves. Refrigerant gas, compressed in the compression chamber, causes a discharge valve in the discharge port to open, which allows the gas to be exhausted through a discharge port into the associated discharge chamber.

The flapper type suction valves are opened and closed by the pressure difference between the compression chambers and the suction chamber. When the pressure in the suction chamber is higher than in the compression chambers, as occurs during the suction stroke of the pistons moving from the top dead center to the bottom dead center, the flapper type suction valves are bent or deformed to open the suction ports. The flapper type valves will not open unless the pressure in the suction chamber becomes higher by some degree than that in the compression chambers. The force needed to elastically deform the flapper type valves effectively diminishes the total suction force produced during the suction stroke (this diminishing force, will for convenience, be hereinafter referred to as suction resistance).

This introduces a timing delay respecting the opening of the flapper type valves.

In conventional compressors a lubricating oil mist is normally suspended in the refrigerant gas and supplies the internal parts of the compressor with lubrication. The lubricating oil can be carried to wherever the refrigerant gas flows, and predictably sticks between the flapper type valves and the surface of a valve plate to which the flapper type valves come in close contact. The adhesive property of the lubricating oil between the surface of the valve plate and flapper type valve causes a further delay in opening action of the flapper type valves. This delay in the opening of the flapper type valves reduces the flow rate of the refrigerant gas into the compression chambers, that is, it reduces the volumetric efficiency of the compressor. In addition, even when the flapper type valves are opened, the elastic resistance of the flapper type valves contributes to the overall suction resistance of the gas flow into the compression chambers.

Conventional compressors of this type also tend to exhibit gas leakage from the compression chamber to the suction chamber. Normally during a compression stroke, refrigerant gas leaks from the compression chamber to the suction chamber through a slight clearance between the outer surface of the piston and the inner wall of the associated cylinder bore. This gas leakage reduces the amount of gas discharge from the compression chamber to the discharge chamber, thus reducing the volumetric efficiency.

SUMMARY OF THE INVENTION

It is therefore a primary objective of the present invention to provide a piston type compressor, which includes a rotary valve as a mechanism for supplying gas into compression chambers defined in cylinder bores, and which has a lower gas suction resistance and provides excellent volumetric efficiency.

To achieve the foregoing and other objects and in accordance with the purpose of the present invention, an improved piston-type compressor is provided.

The compressor according to the present invention comprises a housing including a cylinder block, a gas suction chamber formed in the housing to receive uncompressed gas, and a rotatable drive shaft mounted in the housing to extend into the cylinder block. The cylinder block has a plurality of axial cylinder bores formed around the drive shaft. A plurality of pistons are respectively disposed in the cylinder bores, each of the pistons defining a compression chamber in the associated cylinder bore. The compressor further comprises a piston driving mechanism for causing the pistons to reciprocate in cooperation with the drive shaft. A discharge chamber is formed in the housing, for providing compressed gas contained in the compression chambers outside the compressor. A valve receiving chamber is formed around the drive shaft in the cylinder block, and has an inner wall surrounding the drive shaft. A rotary valve is fittingly received in the valve receiving chamber, and has an outer surface urgably contacting the inner wall of the valve receiving chamber. The rotary valve is supported on the drive shaft to rotate in synchronism with the rotation of the drive shaft. The rotary valve has a suction passage formed therein for providing gases contained in the gas suction chamber to the compression chamber during the chamber's gas suction stroke.

A plurality of communication passages are formed in the cylinder block, for providing gas communication between the compression chambers and the valve suction passage. A bypass passage is formed in the rotary valve, for permitting gas communication between one of the compression chambers completing a compression stroke, and one of the compression chambers starting a compression stroke. The compressor further includes a device, provided between an outer surface of each piston and an inner wall surface of each associated cylinder bore, for capturing gas leaking in an axial direction along the outer surface of the piston. The device provides the captured gas to one of the communication passages.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiment together with the accompanying drawings.

FIG. 1 is a longitudinal cross section showing the overall compressor;

FIG. 2 is a longitudinal cross section showing a part of the internal mechanism of the compressor;

FIG. 3 is a transverse cross section taken along the line A—A in FIG. 1;

FIG. 4 is a transverse cross section taken along the line B—B in FIG. 1;

FIG. 5 is a transverse cross section taken along the line C—C in FIG. 1;

FIG. 6 is a transverse cross section taken along the line D—D in FIG. 1;

FIG. 7 is a graph showing the relation between the rotational angle of the rotary valve and the inner pressure of compression chambers;

FIG. 8 is a perspective view of a rotary valve of the compressor; and

FIG. 9 is a perspective view of another example of the rotary valve.

FIG. 10 is a longitudinal cross section showing the overall compressor; and

FIG. 11 is a transverse cross section taken along the line E—E in FIG. 10.

DETAILED DESCRIPTION OF THE PREFERRED EMBODIMENTS

A swash plate type compressor equipped with double-headed pistons according to the first embodiment of the present invention will now be described referring to the accompanying drawings.

Figure 1:
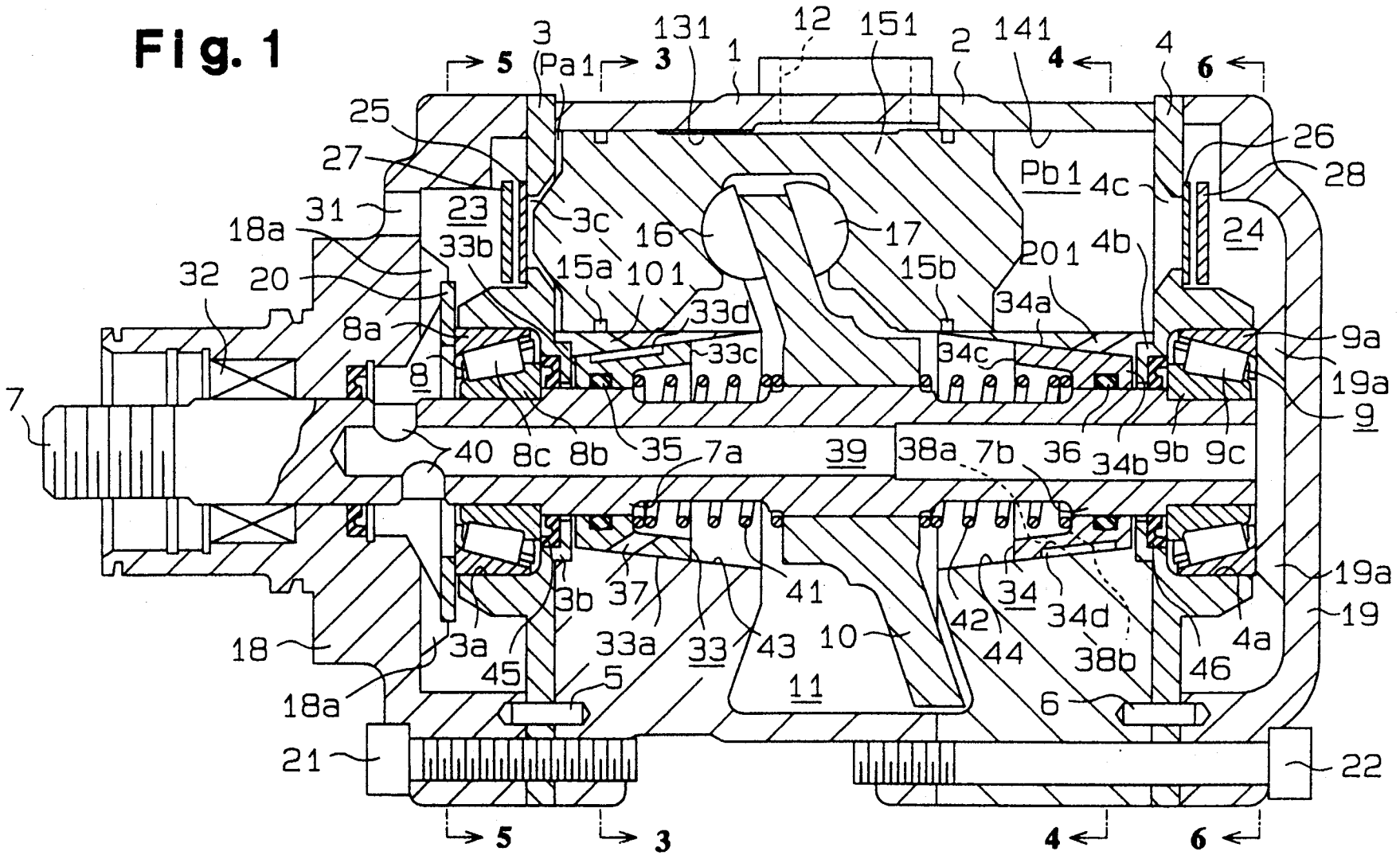
FIGS. 1 through 9 illustrate a piston type compressor according to a first embodiment of this invention.

Front and rear cylinder blocks 1 and 2 are connected together and respectively have valve receiving chambers 43 and 44 formed through the center portions of those cylinder blocks 1 and 2 as shown in FIG. 1. Valve plates 3 and 4 are attached to the ends of the cylinder blocks 1 and 2. The valve plates 3 and 4 respectively have recessed receipt bores 3*a* and 4*a* and annular flange portions 3*b* and 4*b* protrusively provided in the vicinity of the receipt bores 3*a* and 4*a*. The flange portions 3*b* and 4*b* are respectively disposed within the valve receiving chambers 43 and 44 to position the valve plates 3 and 4 with respect to the cylinder blocks 1 and 2.

Pins 5 and 6 are attached to the valve plates 3 and 4 and the cylinder blocks 1 and 2 so as to position the valve plate 3 and 4 and to inhibit the relative rotations of the valve plates 3 and 4 to the cylinder blocks 1 and 2. A drive shaft 7 is rotatably supported in the receipt bores 3*a* and 4*a* via tapered roller bearings 8 and 9. The tapered roller bearings 8 and 9 receive the thrust force and radial force from the drive shaft 7. The roller bearings 8 and 9 respectively have outer rings 8*a*,9*b* and inner rings 8*b*,9*b*, and rollers 8*c*,9*c*.

Seal rings 45 and 46 are provided between the valve plates 3,4 and drive shaft 7. A swash plate 10 is securely fitted over the drive shaft 7. Gas inlet ports 12 are formed in the cylinder block 1 to connect a swash-plate chamber 11, formed in the cylinder blocks 1 and 2, to a refrigerant gas inlet passage (not shown) in an air conditioning system in a vehicle.

Figure 3:
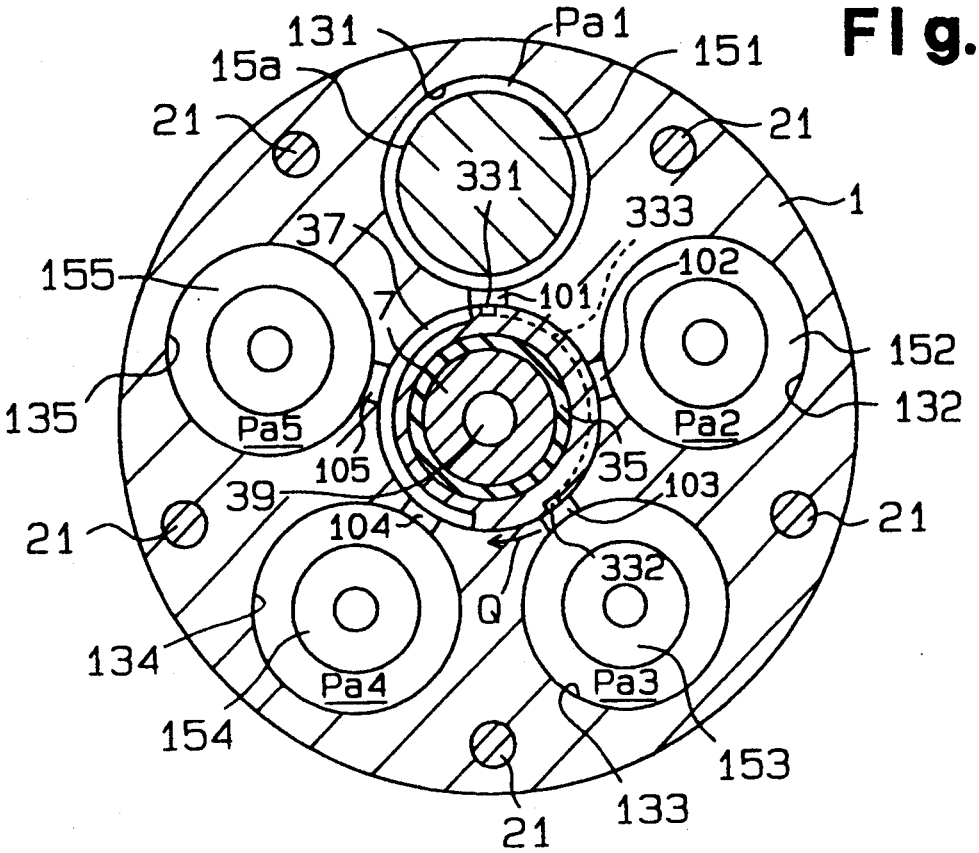
Figure 4:
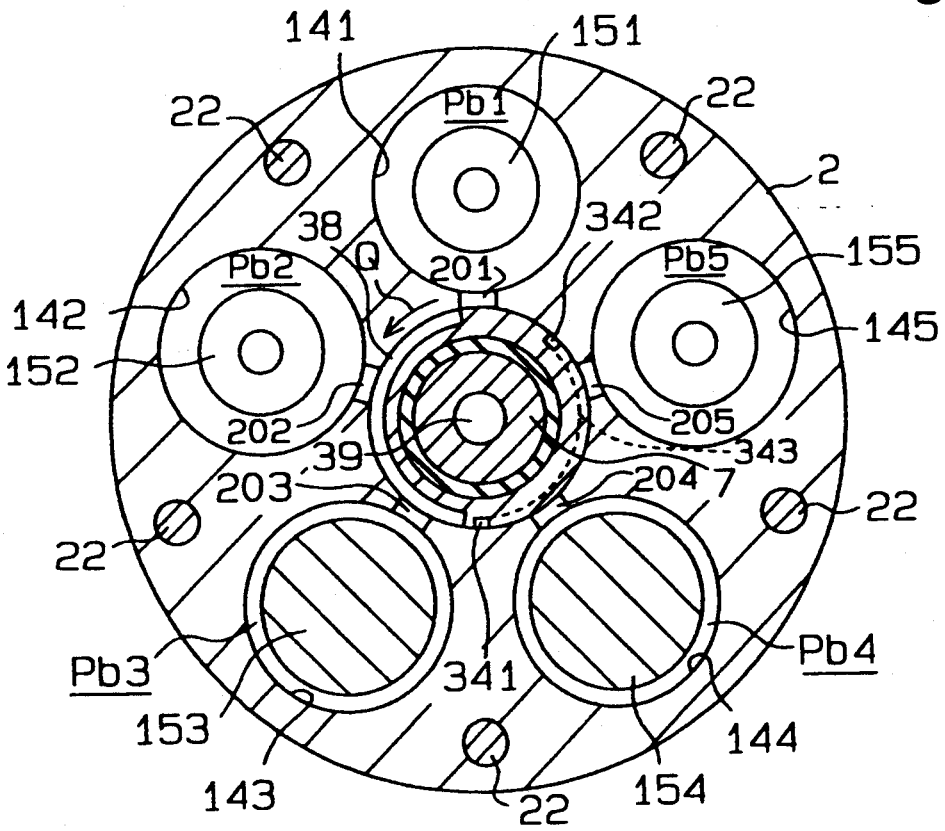

As shown in FIGS. 3 and 4, a plurality of cylinder bores 131,132,133,134,135 and 141,142,143,144,145 (ten cylinder bores in this embodiment) are formed equianguly in the cylinder blocks 1 and 2 around the drive shaft 7. The individual cylinder bores 131,132,133,134 and 135 of the front block 1 respectively correspond to the cylinder bores 141,142,143,144 and 145 of the rear block 2. Double-headed pistons 151,152,153,154 and 155 are retained in each pair of cylinder bores (five pairs in this embodiment) in such a way that the pistons 151,152,153,154 and 155 can reciprocate in the cylinder bores. As shown in FIG. 1, each piston incorporates a piston head on both ends of the piston and is therefore essentially a double headed piston. The peripheral portion of the swash plate 10 is placed between both piston heads, with hemispherical shoes 16 and 17 provided between the piston heads and the swash plate 10. The rotation of the swash plate 10 together with the drive shaft 7 causes all the double-headed pistons 151,152,153,154 and 155 to reciprocate in the respective cylinder bores 131 to 135 and 141 to 145.

Figure 5:
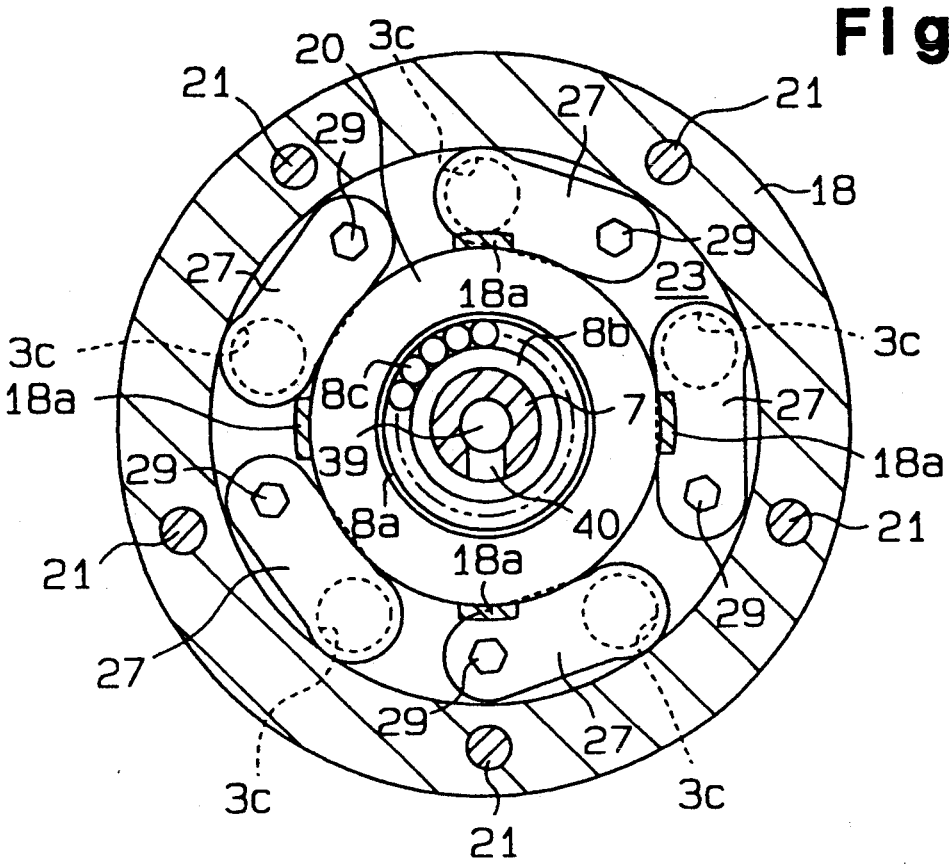
Figure 6:
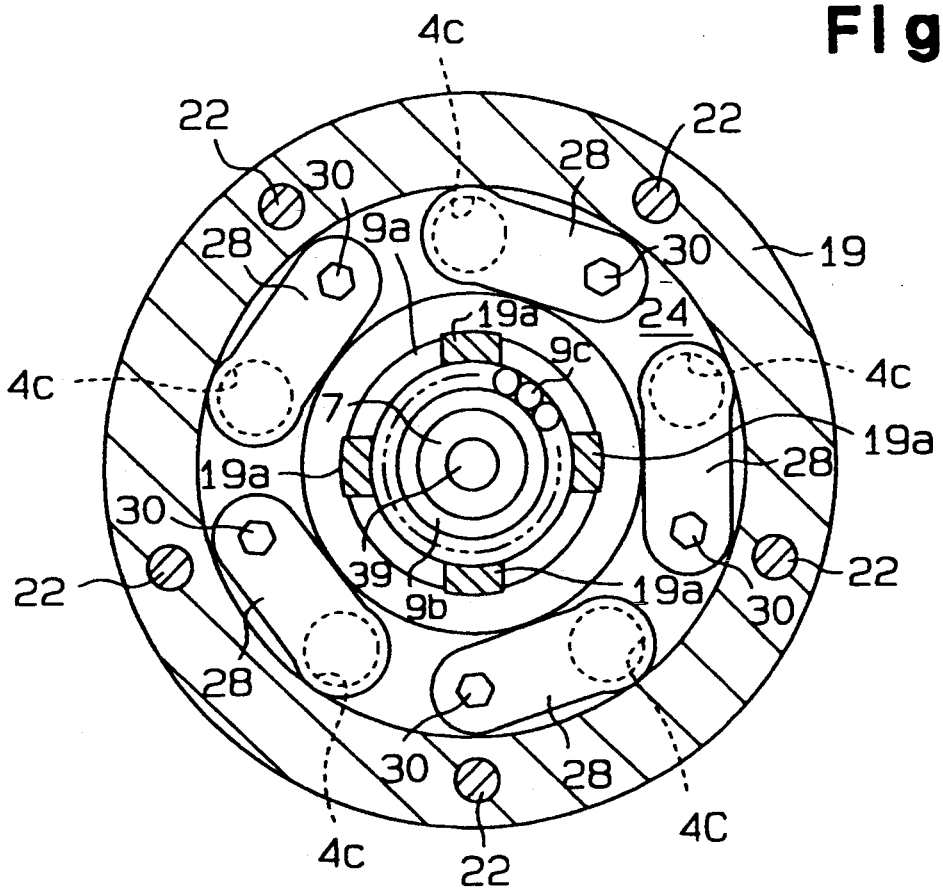

As shown in FIG. 1, each of the double-headed pistons 151 to 155 has gas catching annular grooves 15*a* and 15*b* formed on its outer surface. A front housing 18 is attached to the front end of the front cylinder block 1, and a rear housing 19 is attached to the rear end of the rear cylinder block 2. As shown in FIGS. 1, 5 and 6, a plurality of retaining projections 18*a* and 19*a* are provided on the inner walls of both housings 18*a* and 19. An annular spring 20 is disposed between the front retaining projections 18*a* and the outer ring 8*a* of the roller bearing 8. The rear retaining projection 19*a* abuts on the outer ring 9*a* of the roller bearing 9. The inner rings 8*b* and 9*b*, which respectively hold the rollers 8*c* and 9*c* in cooperation with the outer rings 8*a* and 9*a*, abut on the corners of step portions 7*a* and 7*b* of the drive shaft 7.

The front cylinder block 1, the front valve plate 3 and the front housing 18 are fastened by five bolts 21. The front and rear cylinder blocks 1 and 2, the rear valve plate 4 and the rear housing 19 are fastened by five bolts 22. The fastening of the bolts 21 elastically deforms the annular spring 20. The deformed spring 20 applies a preload to the drive shaft 7 via the roller bearing 8 in the thrust direction.

Front and rear discharge chambers 23 and 24 are defined by the front housing 18 and the front valve plate 3 and by the rear housing 19 and the rear valve plate 4, respectively. Compression chambers Pa1,Pa2,Pa3,Pa4,-Pa5 and Pb1,Pb2,Pb3,Pb4,Pb5 are defined in the respective pairs of cylinder bores 131 to 135 and 141 to 145 by the associated double-headed pistons, the reciprocating motion of which creates suction and compression pressures within chambers Pa1 to Pa5 and Pb1 to Pb5. These chambers communicate with the discharge chambers 23 and 24 via discharge ports 3c and 4c formed in the respective valve plates 3 and 4.

Flapper type discharge valves 25 and 26 and retainers 27 and 28 are secured onto the respective valve plates 3 and 4 by bolts 29 and 30. The discharge valves 25 and 26 control the opening and closing of the associated discharge ports 3c and 4c. The retainers 27 and 28 restrict the opening angles of the associated discharge valves 25 and 26 to prevent the valves 25 and 26 from being damaged.

The front end of the drive shaft 7 protrudes from the front housing 18, and is coupled to the driving source (not shown), such as the engine of an automobile. The rear end of the drive shaft 7 protrudes into the rear discharge chamber 24. The drive shaft 7 has a discharge passage 39 formed along the axial center. This discharge passage 39 is open to the rear discharge chamber 24, and communicates with the front discharge chamber 23 via an outlet port 40 formed in the drive shaft 7 within the discharge chamber 23. The front discharge chamber 23 communicates with a refrigerant gas outlet passage (not shown) in the aforementioned air conditioning system via an outlet port 31 formed in the front housing 18. Thus, the rear discharge chamber 24 also communicates with the refrigerant gas outlet passage via the discharge passage 39, the outlet port 40, the front discharge chamber 23 and the outlet port 31.

A lip seal 32 is provided around the drive shaft 7 at the center portion of the front housing 18 to prevent the refrigerant gas from leaking from the discharge chamber 23 outside the compressor along the surface of the drive shaft 7. Seal rings 45 and 46 are provided around the drive shaft 7, adjacent to the respective annular flange portions 3b and 4b to prevent the compressed refrigerant gas from leaking into the plate chamber 11 from the discharge chambers 23 and 24.

Figure 2:
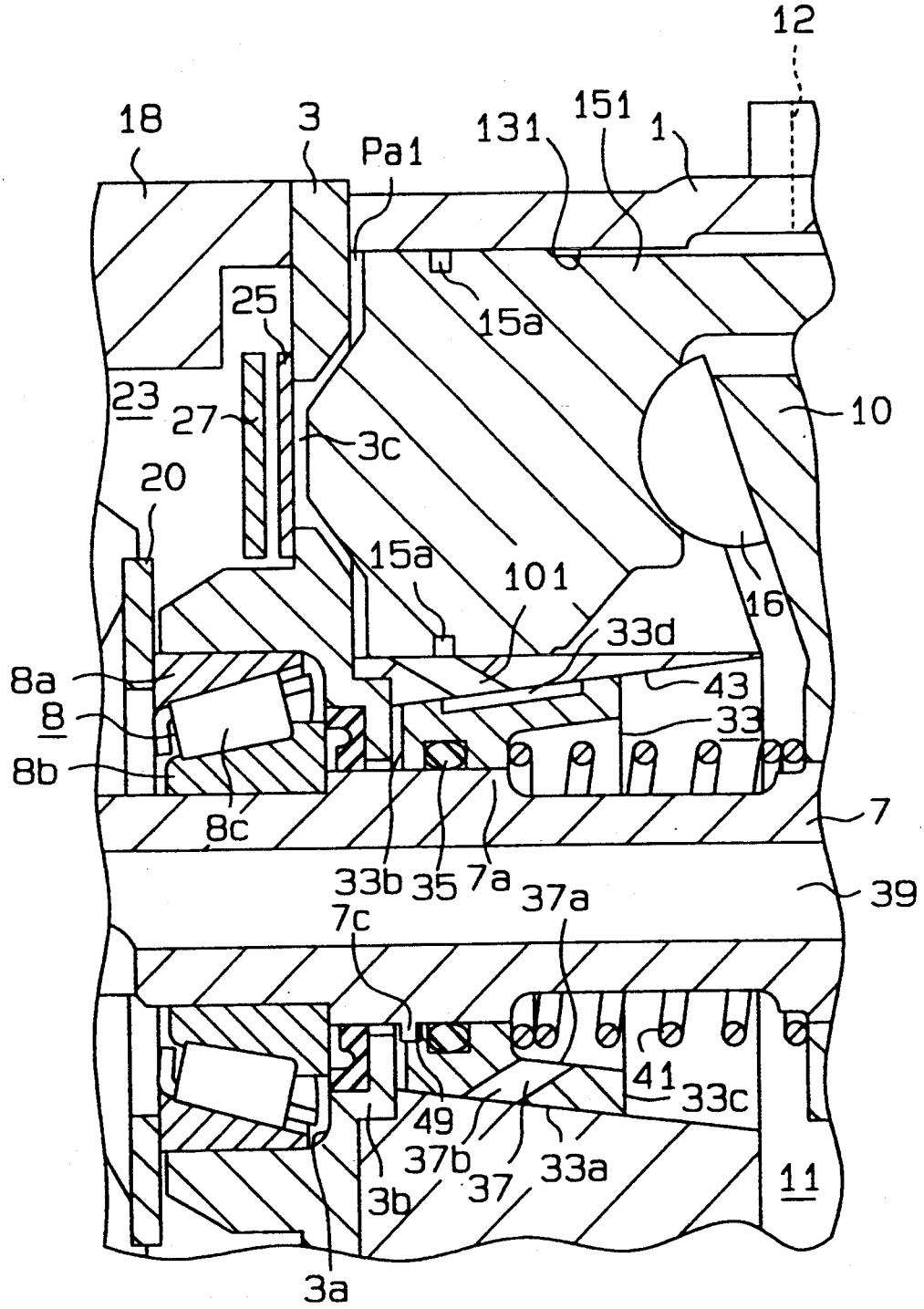
Figure 8:
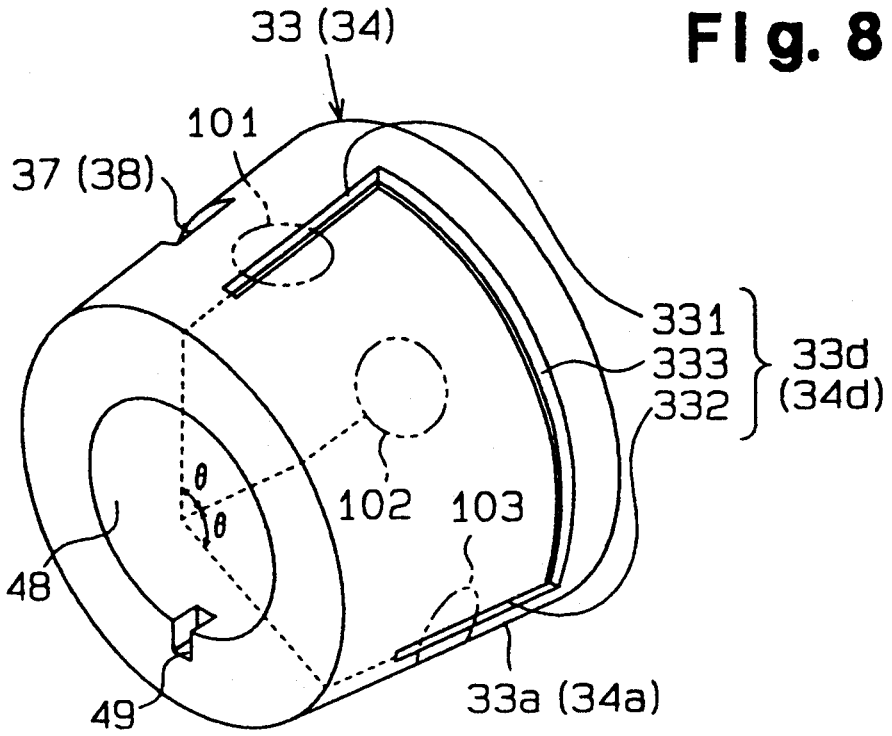

As shown in FIG. 1, rotary valves 33 and 34 are mounted on two annular raised portions 7a and 7b of the drive shaft 7, with seal rings 35 and 36 disposed between the rotary valves 33 and 34 and the drive shaft 7, in such a manner that the rotary valves 33 and 34 are movable in the thrust direction (the direction along the drive shaft 7). The rotary valves 33 and 34 are respectively retained in the valve receiving chambers 43 and 44, and can rotate in the direction of an arrow Q in FIGS. 3 and 4 together with the drive shaft 7. As shown in FIG. 8, each of the rotary valves 33 and 34 has a hole 48 through which the drive shaft 7 is fitted, and a recess 49 formed to face the hole 48. As shown in FIG. 2, the drive shaft 7 has projections 7c corresponding to the recesses 49 of the rotary valves, so that the projections 7c and recesses 49 permit the rotary valves 33,34 to rotate together with the drive shaft 7 and to slide along the drive shaft 7.

Each of the valve receiving chambers 43 and 44 has a tapered inner wall whose inside diameter becomes wider toward the swash plate 10. The rotary valves 33 and 34 respectively have tapered outer surfaces 33a and 34a (truncated cone shapes) in association with the respective valve receiving chambers 43 and 44. Therefore, both tapered outer surfaces 33a and 34a firmly contact the tapered inner walls of the associated valve receiving chambers 43 and 44. As shown in FIG. 2, large-diameter end portions 33c and 34c of the rotary valves 33 and 34 face each other with the plate chamber 11 in between. A small-diameter end portion 33b of the rotary valve 33 is directed toward the front discharge chamber 23, and a small-diameter end portion 34b of the rotary valve 34 is directed toward the rear discharge chamber 24.

Springs 41 and 42 are disposed between the center boss portion of the swash plate 10 and the rotary valves 33 and 34, respectively. Those springs 41 and 42 urge the associated rotary valves 33 and 34 toward the associated roller bearings 8 and 9 to press the tapered outer surfaces 33a and 34a against the tapered inner walls of the valve receiving chambers 43 and 44.

As shown in FIGS. 1 and 2, the rotary valves 33 and 34 are provided inside with suction passages 37 and 38, respectively. The suction passage 37 (38) has an inlet 37a (38a) open to the large-diameter end portion 33c (34c), and an outlet 37b (38b) open to the outer surface 33a (34a).

As shown in FIG. 3, five suction ports 101,102,103,104 and 105 corresponding to five cylinder bores 131 to 135 are equiangularly formed (72°) in the front cylinder block 1. Each suction port has an inner end open to the tapered inner wall of the valve receiving chamber 43, and an outer end open to the inner wall of the associated cylinder bore. Further, the inner end of each suction ports 101 to 105 is positioned within the circulation area of the outlet 37b of the suction passage 37 when the rotary valve 33 rotates. Therefore, the individual compression chambers in the front cylinder bores 131 to 135 can communicate with the plate chamber 11 via the associated suction ports 101 to 105 and the suction passage 37 of the rotary valve 33.

As shown in FIG. 4, the rear cylinder block 2, like the front cylinder block 1, has five suction ports 201 to 205 equiangularly formed (72°) in association with five cylinder bores 141 to 145. The inner end of each suction port is positioned within the circulation area of the outlet 38b of the suction passage 38 when the rotary valve 34 rotates. Therefore, the individual compression chambers in the rear cylinder bores 141 to 145 can communicate with the plate chamber 11 via the associated suction ports 201 to 205 and the suction passage 38 of the rotary valve 34.

As shown in FIG. 8, passages 33d and 34d are recessed bypass passages formed as grooves in tapered outer surfaces 33a and 34a of the rotary valves 33 and 34. The bypass passages 33d and 34d are located opposite to the outlets 37b and 38b of the suction passages 37 and 38, with respect to the rotational axes of the rotary valves 33 and 34. The bypass passage 33d of the front rotary valve 33 has two communication grooves 331 and 332 extending along the rotational axis, and a circulation groove 333 for connecting both grooves 331 and 332. The two communication grooves 331 and 332 can be connected to the openings of the suction ports 101 to 105. The circulation groove 333 extends along the rotational direction of the rotary valve 33 in an arc locus positioned so as to avoid the area where the outer surface 33a of the rotary valve 33 contacts the opening of each of the suction ports 101 to 105. The angle ($2\theta$) between the two communication grooves 331 and 332, with respect to the rotational axis of the rotary valve 33, is set to two times the angle ($\theta$) between the adjoining suction ports (e.g., 101 and 102), i.e., the angle is set to 144 degrees.

Like the bypass passage 33*d* of the front rotary valve 33, the bypass passage 34*d* of the rear rotary valve 34 has two axial communication grooves 341 and 342 and a circulation groove 343 for connecting both grooves 341 and 342, as shown in FIG. 4. The angle between the two communication grooves 341 and 342 with respect to the rotational axis of the rotary valve 34 is set to 144 degrees.

When the left head of one double-headed piston (see 151 in FIG. 2) is near the top dead center with respect to the associated compression chamber Pa1, the annular groove 15*a* of the piston communicates with the associated suction passage 101. When one of the double-headed pistons 151 to 155 is near the top dead center with respect to the associated one of the compression chambers Pb1 to Pb5, the annular groove 15*b* communicates with the associated suction passages 201 to 205.

FIGS. 1, 3 and 4 illustrate a case where the double-headed piston 151 is at the top dead center with respect to the associated front cylinder bore 131, and is at the bottom dead center with respect to the associated rear cylinder bore 141. During the suction stroke, when the piston 151 moves toward the bottom dead center from the top dead center with respect to the front bore 131, the suction passage 37 communicates with the compression chamber Pal in the cylinder bore 131, allowing the refrigerant gas in the swash plate chamber 11 to be led into the compression chamber Pa1 via the suction passage 37.

In the discharge stroke where the piston 151 moves toward the top dead center from the bottom dead center with respect to the rear cylinder bore 141, the communication of the suction passage 38 with the compression chamber Pb1 in the rear cylinder bore 141 is blocked. Therefore, the compressed refrigerant gas in the compression chamber Pb1 is discharged into the rear discharge chamber 24 from the discharge port 4*c* while pushing the discharge valve 26 back. These suction and discharge processes of the refrigerant gas are similarly performed for the other compression chambers Pa2 to Pa5 and Pb2 to Pb5 of other cylinder bores 132 to 135 and 142 to 145.

Usually, in a conventional compressor equipped with a flapper type suction valve in the vicinity of the suction port of the compression chamber, a lubricating oil attached to the valve may cause the suction valve to adhere to the plate surface which the valve contacts. With too much adherence, the opening of the suction valve is undesirably delayed. This delay and the large suction resistance from the elasticity of the suction valve operate to reduce the volumetric efficiency of the compressor.

The use of the rotary valves 33 and 34 which rotate together with the drive shaft 7 as in this invention, however, avoids the difficulties relating to the adherence of lubricating-oil between the suction valves and the plate surfaces as well as the disadvantage occasioned by the suction resistance produced by the elastic resistance of the suction valves. This results due to the fact that when pressure in the each compression chamber Pa1 to Pa5, or Pb1 to Pb5 becomes slightly less than the suction pressure in the plate chamber 11, the refrigerant gas spontaneously flows into the compression chamber. Because of the use of the rotary valves 33 and 34 instead of the flapper type suction valves, therefore, this invention significantly improves the volumetric efficiency as compared with the conventional compressor which uses the flapper type suction valves.

When the pressure in the compression chamber becomes lower than the pressure in the swash plate chamber 11, the refrigerant gas in the swash plate chamber 11 flows into the associated compression chambers Pa1 to Pa5 and Pb1 to Pb5. When the resistance in the refrigerant gas passage from the swash plate chamber 11 to each of the compression chambers Pa1 to Pa5 and Pb1 to Pb5 is high, i.e., when the suction resistance is high, the pressure loss becomes larger, thus reducing the volumetric efficiency. Because of the use of the rotary valves 33 and 34, the refrigerant gas passage from the swash plate chamber 11 to each of the compression chambers Pa1 to Pa5 and Pb1 to Pb5 is shortened. This reduces the effect of the suction resistance and improves the compressor's volumetric efficiency more so than conventional piston type compressor.

The swash plate chamber 11 constitutes a part of the suction pressure area, and the discharge chambers 23 and 24 constitute a part of the discharge pressure area. The seal rings 45 and 46 prevent the high-pressure refrigerant gas in the discharge chambers 23 and 24 from leaking toward the valve receiving chambers 43 and 44.

When the compression chambers Pa1 to Pa5 and Pb1 to Pb5 are in the discharge stroke, the communication of the associated suction ports 101 to 105 and 201 to 205 with the respective suction passages 37 and 38 are blocked. Like the pressures in the compression chambers Pa1 to Pa5 and Pb1 to Pb5, the pressures in the suction ports 101 to 105 and 201 to 205 therefore rise. If the sealing between the inner walls of the valve receiving chambers 43 and 44 and the tapered outer surfaces 33*a* and 34*a* of the rotary valves 33 and 34 were not so tight, the compressed refrigerant gas in each compression chamber might leak toward the swash plate chamber 11. According to the present invention, however, the sealing between the valve receiving chambers 43 and 44 and the associated rotary valves 33 and 34 is improved sufficiently by the action of the springs 41 and 42, so that the refrigerant gas will not leak through the slight gaps between the chambers 43 and 44 and the rotary valves 33 and 34. This contributes to improving the volumetric efficiency of the compressor.

The action of the compressor of this embodiment will be discussed below. In the example illustrated in FIGS. 2 and 3, the double-headed piston 151 is positioned at the top dead center with respect to the left cylinder bore 131. The suction passage 37 is almost at a position to communicate with the compression chamber Pa1 of the cylinder bore 131. This occurs when, the compression stroke in the compression chamber Pa1 is nearly finished. With the piston 151 having nearly finished its compression stroke, the pressure in the compression chamber Pa1 approaches a maximum pressure Pd. It is at this time that the compressed refrigerant gas tends to leak from the compression chamber Pa1 through the gap between the piston's outer surface and the inner wall of the cylinder bore. According to the present invention, however, any gas leaked would be caught by the annular groove 15*a* formed on the surface of the piston head.

As shown in FIG. 2, the gas catching annular groove 15*a* is connected to the suction port 101 of the compression chamber Pa1 slightly before the end of the compression stroke. As shown in FIG. 3, the first communication groove 331 of the rotary valve 33 is connected to the suction port 101, while the second communication groove 332 is connected to the suction port 103. Therefore, the catching groove 15*a* communicates with the compression chamber Pa3 via the suction port 101, the bypass passage 33*d* and the suction port 103.

When the compression chamber Pa3 is ready to undergo compression, the pressure in the compression chamber Pa3 is very close to the pressure Ps in the compression chamber which is undergoing a suction stroke. Therefore, the pressure in the annular groove 15*a* which catches the refrigerant gas leaking from the compression chamber Pa1 under the maximum pressure Pd is higher than the pressure in the compression chamber Pa3. This causes the refrigerant gas in the catching groove 15*a* to flow along the bypass passage 33*d* into the compression chamber Pa3. The suction port 103 of the compression chamber Pa3 which has entered the compression stroke is blocked from the suction passage 37 of the rotary valve 33. Therefore, the refrigerant gas led along the bypass passage 33*d* to the compression chamber Pa3 from the catching groove 15*a* will not leak out to the swash plate chamber 11.

If the high-pressure refrigerant gas were to leak to the swash plate chamber 11 from the compression chamber Pa1 through the gap between the outer surface of the double-headed piston 151 and the inner wall of the cylinder bore 131, the volumetric efficiency of the compressor would decrease. Leakage of refrigerant gas to the swash plate chamber from the compression chamber is inevitable in the conventional piston type compressor. According to this embodiment, in contrast, the high-pressure refrigerant gas, which has leaked from the compression chamber Pa1 through the gap between the piston 151 and the cylinder bore 131, will be communicated to the compression chamber Pa3 without flowing into the swash plate chamber 11. The amount of the refrigerant gas flowing into the compression chamber Pa3, thus becomes the sum of the amount of gas supplied via the suction passage 37 from the swash plate chamber 11 and the amount of gas flowing via the bypass passage 33*d* from the catching groove 15*a*. This embodiment therefore improves the volumetric efficiency as compared with the conventional piston type compressor.

Figure 7:
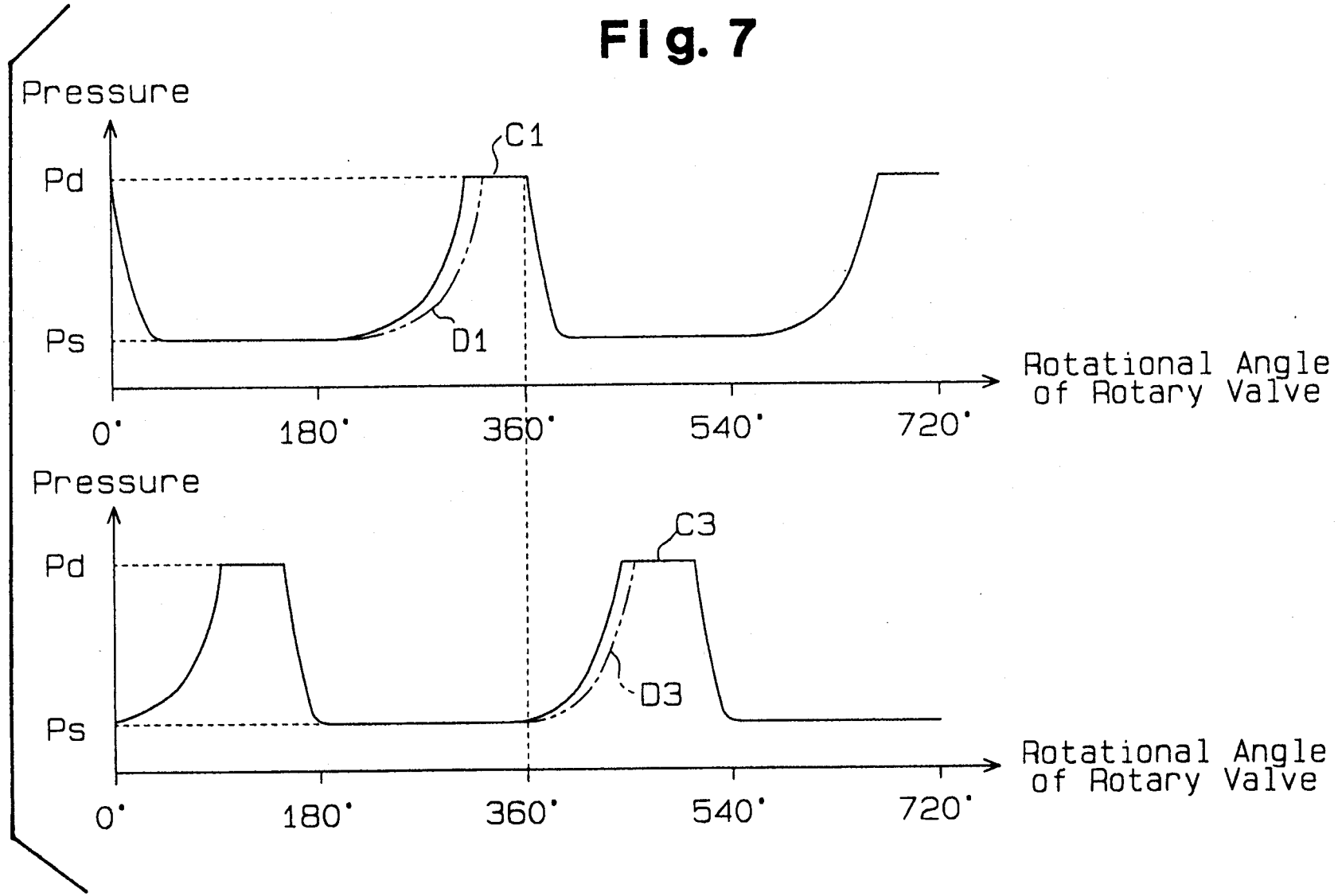

Curves C1 and C3 in FIG. 7 respectively show changes in pressure in the compression chambers Pa1 and Pa3. At the rotational angles of 0 degree, 360 degrees and 720 degrees, the double-headed piston 151 is located at the top dead center with respect to the compression chamber Pa1. Curves D1 and D3 in FIG. 7 show pressure changes in the conventional piston type compressor that has neither the catching groove 15*a* nor the bypass passage 33*d*. The curves C1 and C3 are located above the curves D1 and D3 due to the increased pressure of the refrigerant gas in the compression chamber Pa1. This gas flows into the compression chamber via the bypass passage 33*d* from the catching groove 15*a* in this embodiment.

The action to move the refrigerant gas leaking from the compression chamber, slightly before the end of a compression stroke, to another compression chamber, which is ready to start the compression stroke, is similarly executed between the compression chambers Pa2 and Pa4, between the compression chambers Pa3 and Pa5, between the compression chambers Pa4 and Pa1 and between the compression chambers Pa5 and Pa2. A similar gas moving action will take place for the compression chambers Pb1 to Pb5 by the catching groove 15*b* and the bypass passage 34*d*.

The catching grooves 15*a* and 15*b* in the piston and the bypass passages 33*d* and 34*d* in the rotary valve also serve as grooves and passageways for the lubricating oil mist suspended in the refrigerant gas.

Figure 9:
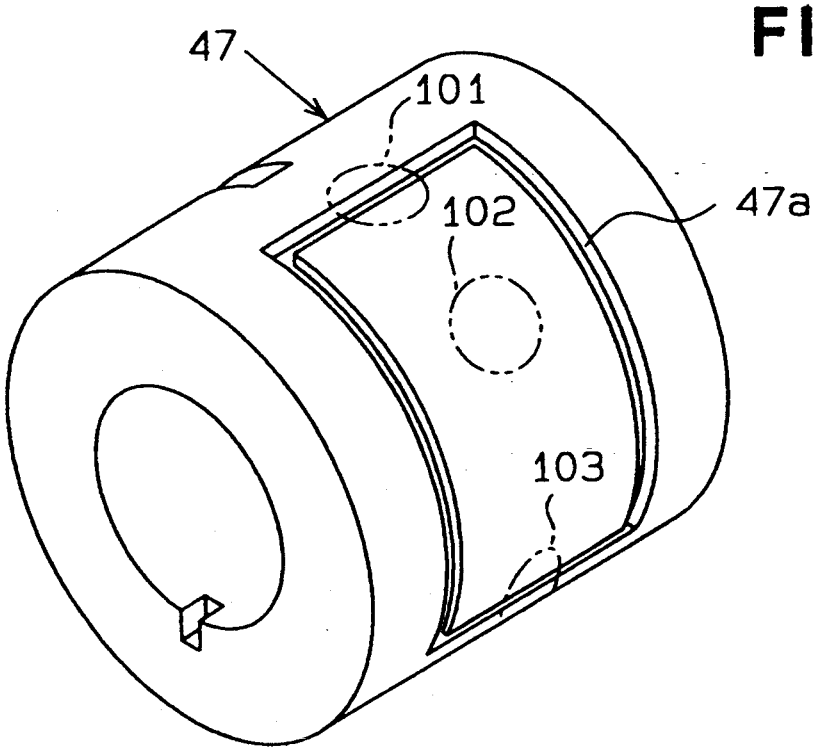

As shown in FIG. 9, for example, a rotary valve 47 may be columnar in shape so that it has its outer surface parallel to the axis of valve 47. In this case, it is desirable that a recessed bypass passage 47*a* be formed in the valve's outer surface so as to enclose the suction port 102 which is associated with the compression chamber during the compression stroke. The bypass passage 47*a* can catch the refrigerant gas which leaks from the suction port 102 of the compression chamber during the compression stroke.

A variable displacement type compressor having a rocking swash plate, according to a second embodiment of the present invention, will now be described with reference to FIGS. 10 and 11.

Figure 10:
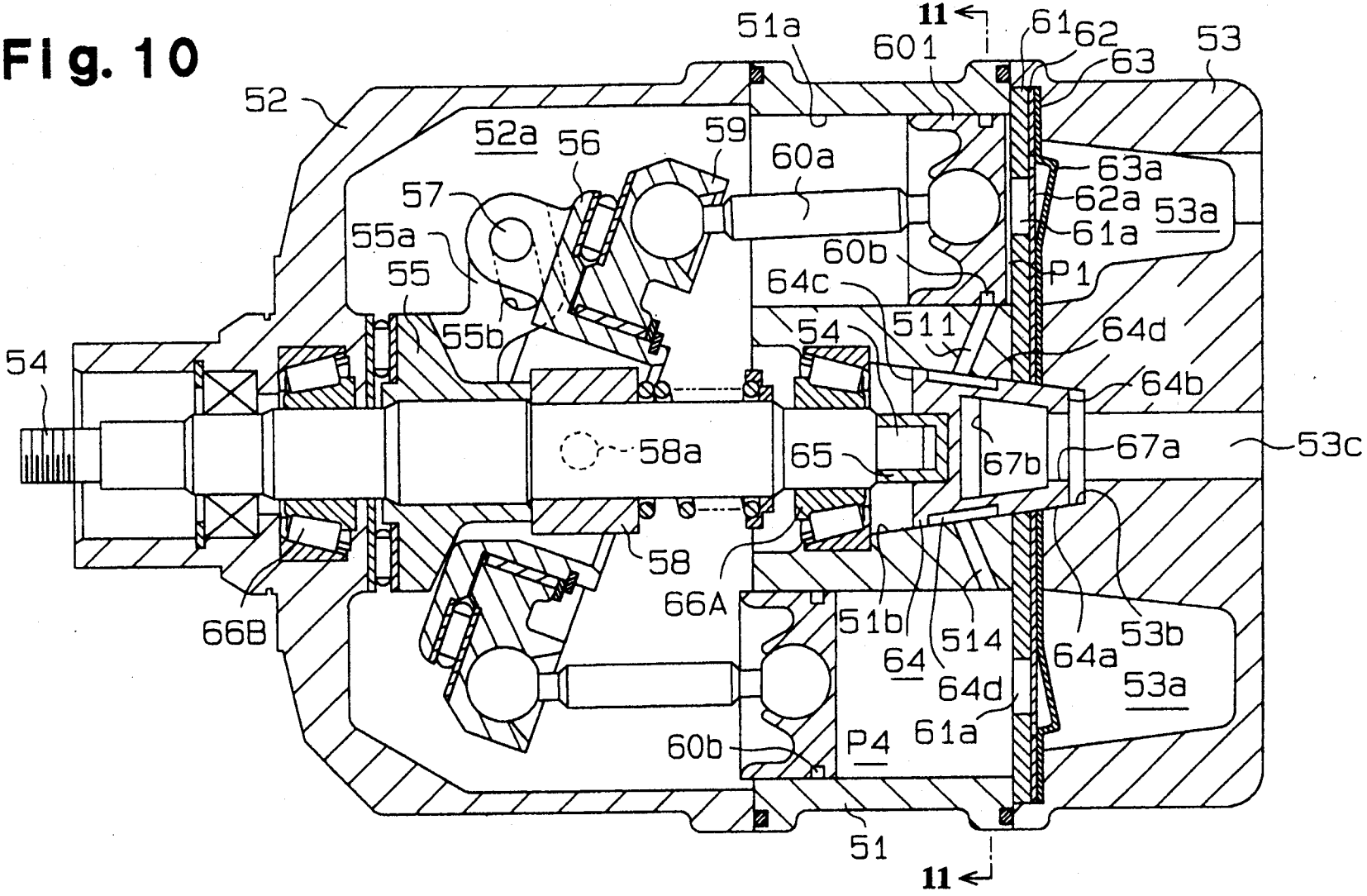
FIGS. 10 and 11 illustrate a piston type compressor according to a second embodiment of this invention.

As shown in FIG. 10, a drive shaft 54 is rotatably supported in a cylinder block 51 and a front housing 52 via cone-shaped roller bearings 66A and 66B. A drive plate 55, secured onto the drive shaft 54, has an arm 55*a* having an elongated hole 55*b*. A rotary journal 56 is coupled to the drive plate 55 by the engagement of the elongated hole 55*b* with a pin 57. The rotary journal 56 is swingably supported on two pins 58*a* (only one shown) protruding from the respective sides of a guide sleeve 58 which is slidable along the drive shaft 54. A rocking swash plate 59 is provided on the rotary journal 56 in such a way as to be rotatable relative to the rotary journal 56.

The cylinder block 51 has a plurality of cylinder bores 51*a* (six bores in this embodiment). Individual pistons 601 to 606 in the respective cylinder bores 51*a* are coupled to the swash plate 59 via associated piston rods 60*a*. The rotational motions of the drive shaft 54, drive plate 55 and rotary journal 56 are converted to the reciprocal undulating movement of the swash plate 59. This reciprocal undulating movement causes an axial reciprocal movement of the pistons 601 to 606. Each piston has an annular catching groove 60*b* formed in its outer surface in the vicinity of the piston head, as per the first embodiment.

Held between the cylinder block 51 and a rear housing 53 are a valve plate 61, a valve-forming plate 62 and a retainer-forming plate 63. An annular discharge chamber 53*a* defined in the rear housing 53 is connected to compression chambers P1, P2, P3, P4, P5 and P6 defined in the respective cylinder bores via discharge ports 61*a* of the valve plate 61. Some parts of the valve-forming plate 62 form a plurality of discharge valves 62*a* corresponding to the discharge ports 61*a*. Those discharge valves 62*a* can be bent toward inside the discharge chamber 53*a* to control the opening/closing of the associated discharge ports 61*a*. Retainers 63*a* formed on the plate 63 restrict the over-bending of the associated discharge valves 62*a*.

The cylinder block 51 and rear housing 53 respectively have recesses 51*b* and 53*b* formed in their center portions. Both recesses 51*b* and 53*b* form a cone-shaped receiving chamber which is concentric to the drive shaft 54. A rotary valve 64 is rotatably housed in the receiving chamber (51*b*, 53*b*). The rotary valve 64 has a tapered outer surface 64*a* which matches with the shape of the receiving chamber (51*b*, 53*b*).

One end of the drive shaft 54 is positioned in the recess 51*b*. The rotary valve 64 has a large-diameter portion 64*c* to which a coupling 65 is secured. The end of the drive shaft 54 is coupled to the coupling 65 such that the coupling 65 is rotatable together with the coupling 65 and slidable. The rotary valve 64 in the receiving chamber (51*b*, 53*b*) rotates together with the drive shaft 54 in the arrowhead direction "R" in FIG. 11.

A suction passage 67 is formed in the rotary valve 64, and has an inlet port 67*a* open to a small-diameter portion 64*b* of the rotary valve 64 and an outlet port 67*b* open to the tapered outer surface 64*a*. An inlet 53*c* is formed in the center portion of the rear housing 53, and communicates with the recess 53*b* and the inlet port 67*a* of the suction passage 67.

The cylinder block 51 has six suction ports 511, 512, 513, 514, 515 and 516 open to the inner wall of the recess 51*b*. The suction ports 511 to 516 are arranged at equal angular intervals in association with the six compression chambers P1 to P6, and are located in a circulation area of the outlet port 67*b* of the suction passage 67.

Figure 11:
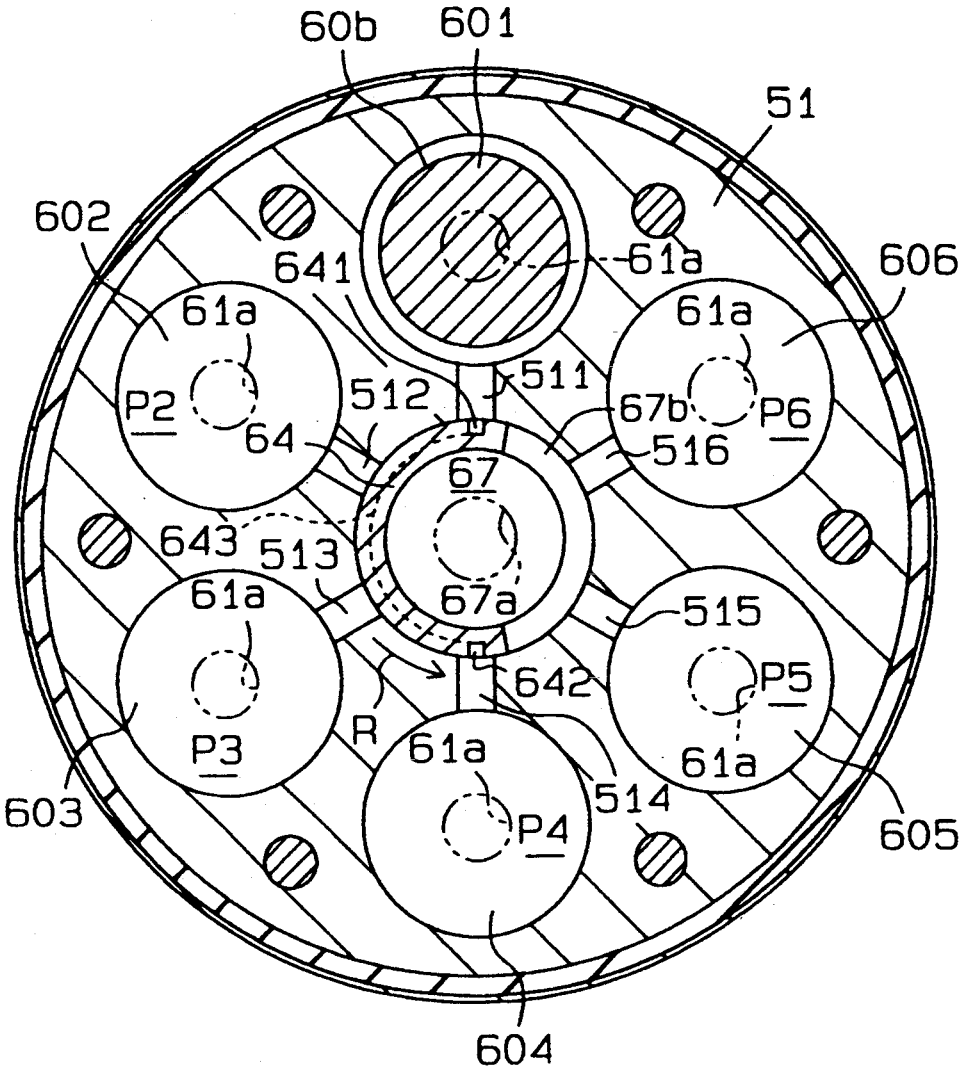

FIGS. 10 and 11 show the piston 601 at the top dead center and the piston 604 at the bottom dead center, the piston 604 being symmetrical to the piston 601 with the drive shaft 54 in between. The refrigerant gas led into any of the compression chambers P1 to P6 is compressed by the compression action of the associated piston moving toward the top dead center from the bottom dead center. When the pressure of the compressed refrigerant gas reaches a predetermined level, the compressed refrigerant gas is discharged into the discharge chamber 53*a* via the discharge port 61*a*. It is well known that the inclined angle of the swash plate 59 varies in accordance with the difference between the pressure in a crank chamber 52*a* and the suction pressure in each compression chamber. This effectively controls the stroke of each piston.

Pressure is controlled in the crank chamber 52*a* by supplying the refrigerant gas in the discharge pressure area (e.g., the discharge chamber 53*a*) to the crank chamber 52*a* and by discharging the refrigerant gas in the crank chamber 52*a* to the inlet port 53*c* connected to the suction pressure area by means of a control mechanism (not shown). At this time, the pressure in the crank chamber 52*a* is higher than that in the suction pressure area.

Any refrigerant gas in the compression chamber during the compression stroke that leaks toward the crank chamber 52*a* along the outer surface of the piston (called "blow-by gas") will be caught by the catching groove 60*b*.

The pressure in the crank chamber 52*a* acts on the large-diameter portion 64*c* of the rotary valve 64, while the pressure in the inlet port 53*c* acts on the small-diameter portion 64*b* of the rotary valve 64. As a result, the rotary valve 64 is urged toward the inlet port 53*c*, pressing the valve's outer surface 64*a* against the inner wall of the receiving chamber (51*b*, 53*b*).

The rotary valve 64 has a bypass passage 64*d* formed on the tapered outer surface 64*a*. The bypass passage 64*d* has two communication grooves 641 and 642 extending along the rotational axis, and a circulation groove 643 extending along the circumferential direction and located near the large-diameter portion 64*c*. As shown in FIG. 11, the bypass passage 64*d* permits the suction port 511 associated with the compression chamber P1, just prior to the completion of the compression stroke, to be connected to the suction port 514 associated with the compression chamber P4, which is at that time just ready to start the compression stroke. In addition, the catching groove 60*b* of the piston 601 communicates with the suction port 511 of the compression chamber P1. Therefore, the refrigerant gas led into the compression chamber P4 is the sum of the refrigerant gas, led from the inlet port 53*c* via the suction passage 67, plus the refrigerant gas flowing from the catching groove 60*b* via the bypass passage 64*d*. The volumetric efficiency of the compressor as envisaged in the present embodiment is much improved over that of the conventional rocking swash plate type compressor.

Although only two embodiments of the present invention have been described herein, it should be apparent to those skilled in the art that the present invention may be embodied in many other specific forms without departing from the spirit or scope of the invention. Particularly, it should be understood that the present invention may be embodied in the following manner.

Figure 12:
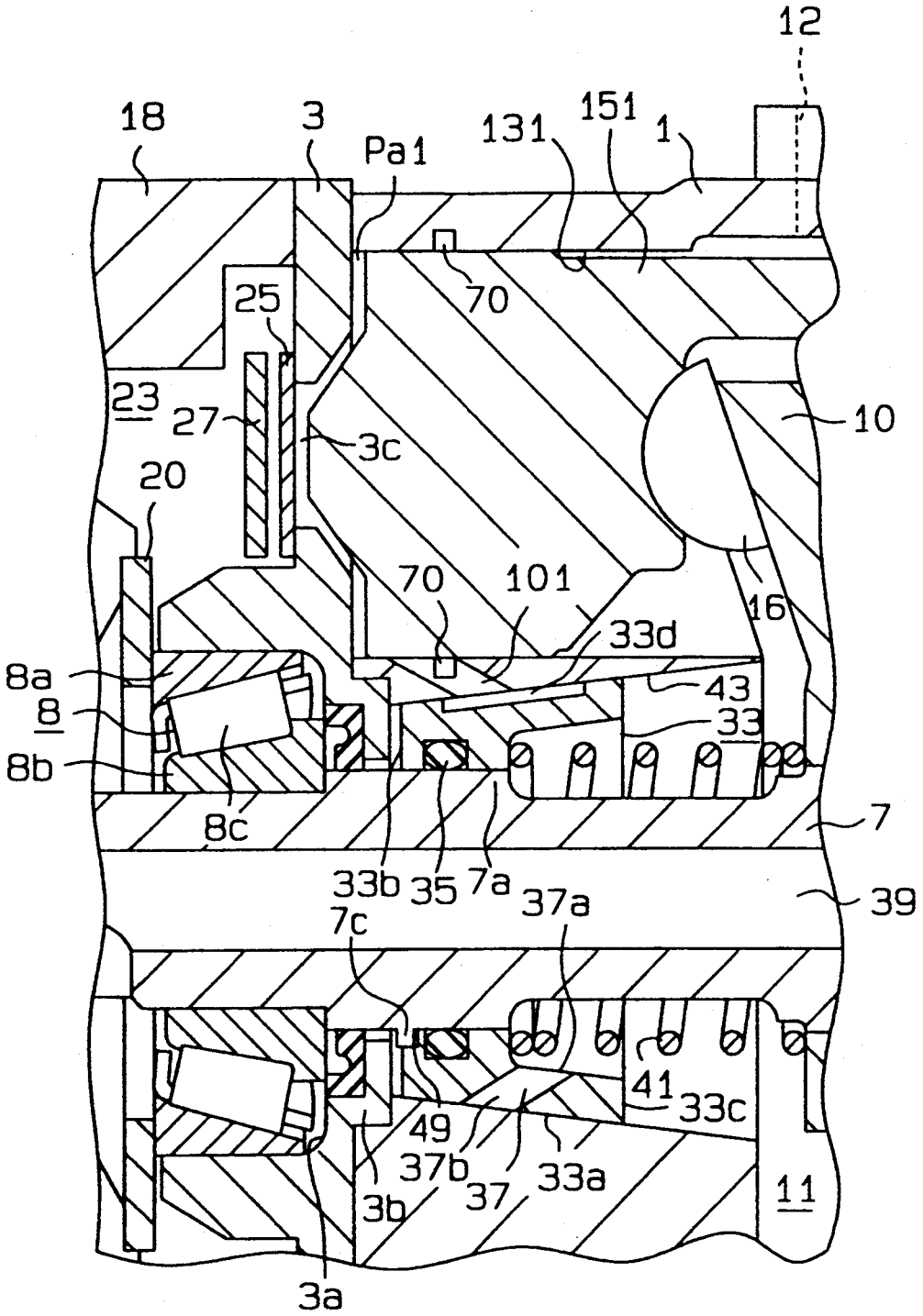
FIG. 12 shows a modification of the first embodiment, and is a view corresponding to FIG. 2.

As shown in FIG. 12, an annular catching groove 70 may be provided in the inner wall of each cylinder bore in such a way that the groove communicates with each suction port or passage, instead of forming a catching groove (15*a*, 15*b*) on the outer surface of each piston.

Each rotary valve may be coupled to the drive shaft in a splined manner.

Therefore, the present examples and embodiments are to be considered as illustrative and not restrictive and the invention is not to be limited to the details given herein, but may be modified within the scope of the appended claims.

What is claimed is:

1. A piston type compressor comprising:

a housing including a cylinder block;

a gas suction chamber formed in said housing, for receiving uncompressed gas;

a rotatable drive shaft mounted in said housing to extend into said cylinder block, said cylinder block having a plurality of cylinder bores formed around said drive shaft;

a plurality of pistons respectively disposed in said cylinder bores, each of said pistons defining a compression chamber in the associated cylinder bore;

a piston driving mechanism for causing said pistons to reciprocate in cooperation with said drive shaft;

a discharge chamber formed in said housing, for providing compressed gas contained in said compression chambers outside the compressor;

a valve receiving chamber formed around said drive shaft in said cylinder block and having an inner wall surrounding said drive shaft;

a rotary valve fittingly received in said valve receiving chamber and having an outer surface urged in contacting relationship with said inner wall of said valve receiving chamber, said rotary valve being supported on said drive shaft to rotate in synchronism with the rotation of said drive shaft, said rotary valve having a suction passage formed therein for providing gases contained in said gas suction chamber to said compression chamber during said compression chamber's gas suction stroke;

a plurality of communication passages formed in said cylinder block for providing gas communication between said compression chambers and said valve suction passage;

a bypass passage formed in said rotary valve for permitting gas communication between one of the compression chambers completing a compression stroke, and one of the compression chambers starting a compression stroke; and means, provided between an outer surface of each piston and an inner wall surface of each associated cylinder bore, for capturing gas leaking in an axial direction along said outer surface of said piston, and for providing the captured gas to one of said communication passages.

2. The compressor according to claim 1, wherein said gas capturing means includes an annular groove circumferentially formed on said outer surface of each of said plurality of pistons.

3. The compressor according to claim 1, wherein said gas capturing means includes an annular groove circumferentially formed on the inner wall of each of said plurality of cylinder bores.

4. The compressor according to claim 1, wherein said piston driving mechanism includes:

an inclined swash plate provided on said drive shaft, for causing undulating movement in accordance with rotation of said drive shaft; and means, provided between said swash plate and each of said pistons, for transmitting said undulating movement to said pistons to cause said pistons to reciprocate.

5. The compressor according to claim 1, wherein said rotary valve has the shape of a substantially truncated cone, and wherein said valve receiving chamber has a mortar shape corresponding to said shape of the rotary valve.

6. The compressor according to claim 5, wherein said bypass passage includes a recessed groove formed on said outer surface of said rotary valve.

7. The compressor according to claim 6, wherein said bypass passage includes a main recessed portion formed along a circumferential direction of said outer surface of said rotary valve, said main recessed portion partially extending around the region of said valve's outer surface where openings of said communication passages contact; and wherein said bypass passage further includes two recessed portions crossing said region and connected to said main recessed portion.

8. The compressor according to claim 5 further comprising means for holding said rotary valve within said valve receiving chamber such that a tapered outer surface of said rotary valve fittingly contacts said inner wall of said valve receiving chamber.

9. The compressor according to claim 8, wherein said holding means includes a spring.

* * * * *

UNITED STATES PATENT AND TRADEMARK OFFICE

CERTIFICATE OF CORRECTION

PATENT NO. : 5,366,350

DATED : November 22, 1994

INVENTOR(S) : T. Fujii et al

It is certified that error appears in the above-indentified patent and that said Letters Patent is hereby corrected as shown below:

Column 1, line 48, after "top" delete comma ",".

Column 3, line 31, "A-A" should read --3-3--; line 33, "B-B" should read --4-4--; line 35 "C-C" should read --5-5--; line 37, "D-D" should read --6-6--; line 50, "E-E" should read --11-11--.

Column 4, line 25 "guly" should read --gularly--.

Signed and Sealed this

Sixteenth Day of May, 1995

*Attest:*

Bruce Lehman

BRUCE LEHMAN

*Attesting Officer*

*Commissioner of Patents and Trademarks*